United States Patent [19]

Brunette

[11] 4,109,797

[45] Aug. 29, 1978

[54] DISPLAY ASSEMBLY

[75] Inventor: Frederick F. Brunette, Farmington, Mich.

[73] Assignee: Bobbie Brunette, Grand Haven, Mich. ; a part interest

[21] Appl. No.: 669,259

[22] Filed: Mar. 22, 1976

[51] Int. Cl.[2] ..... A47F 3/14

[52] U.S. Cl. ..... 211/126; 108/108; 211/187; 211/193; 248/243

[58] Field of Search ..... 211/126, 190, 191, 192, 211/193, 208, 175, 133, 134, 186–188; 108/106, 107, 108; 248/243, 223, 224, 225

[56] References Cited

U.S. PATENT DOCUMENTS

| | | | |
|---|---|---|---|
| 2,191,701 | 2/1940 | Wood | 248/243 X |
| 2,891,678 | 6/1959 | Levy | 211/126 |
| 3,122,238 | 2/1964 | Brunette | 211/126 |
| 3,220,363 | 11/1965 | Gingher | 248/243 X |
| 3,229,823 | 1/1966 | Hummer | 211/187 |
| 3,495,718 | 2/1970 | Romero | 211/126 |
| 3,627,247 | 12/1971 | Krikorian | 248/243 |

*Primary Examiner*—Roy D. Frazier

*Assistant Examiner*—Terrell P. Lewis

*Attorney, Agent, or Firm*—Gifford, Chandler, Van Ophem, Sheridan & Sprinkle

[57] ABSTRACT

An assembly for displaying articles for sale is provided of the type comprising a laterally elongated basket adapted to be secured to a pair of spaced and parallel upright supports. The assembly includes an end support bar secured across each lateral end of the basket and means for removably securing each end support bar to one of the upright supports. The securing means further comprises a member having hooks adapted to be received within receiving slots formed in the upright support and a lateral rod secured to the member and slidably received within registering apertures formed through the end support bar. The rod permits adjustment of the lateral distance between the members on each end of the basket to compensate for misalignment of the hooks with the slots in the upright supports. In addition, the members may be secured to different portions of the end support bar so that the basket display may be maintained in either a generally horizontal position or a downwardly sloping position on the upright supports.

10 Claims, 4 Drawing Figures

Fig-1
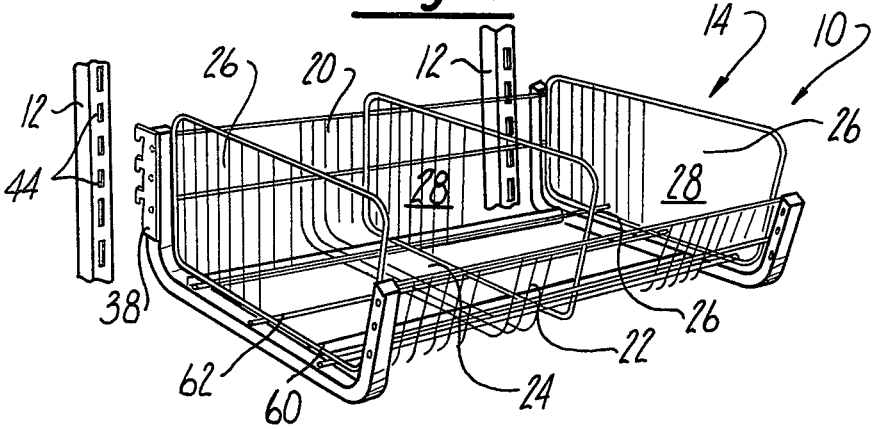
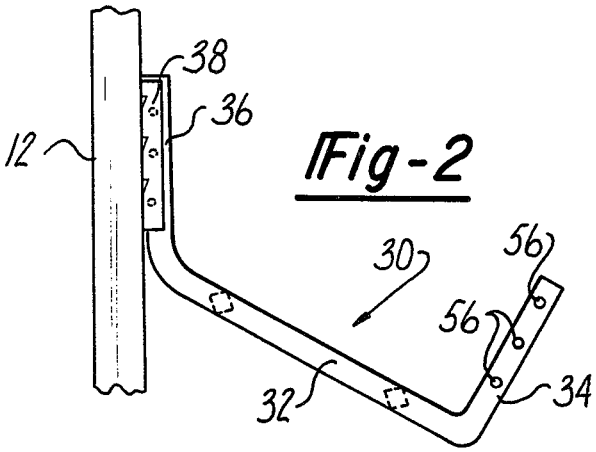
Fig-2
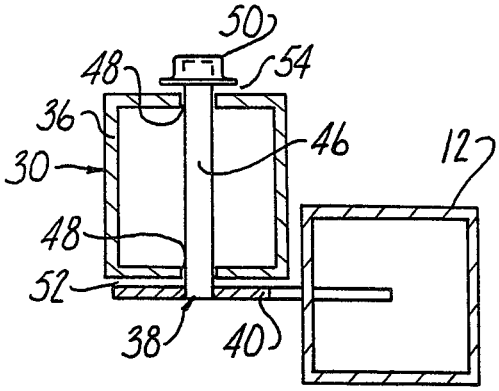
Fig-4
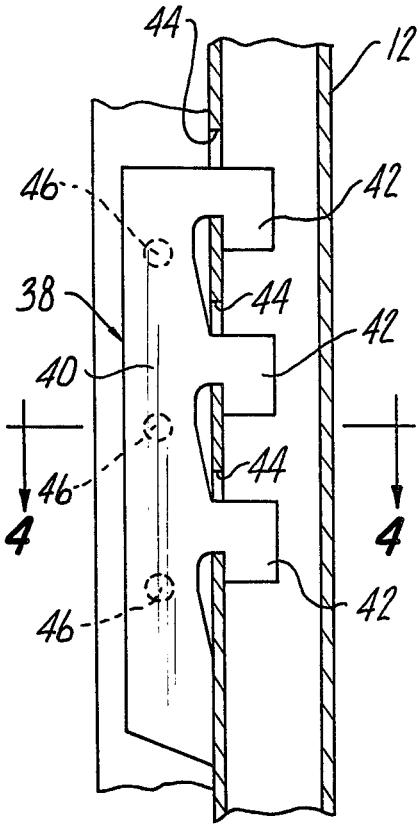
Fig-3

DISPLAY ASSEMBLY

BACKGROUND OF THE INVENTION

I. Field of the Invention

The present invention relates generally to devices for displaying articles for sale, and more particularly, to a display device having a basket and adapted to be secured to a pair of spaced and parallel upright supports.

II. Description of the Prior Art

There have been several previously known devices adapted to display merchandise for sale and of which my previous U.S. Pat. No. 3,122,238 issued on Feb. 25, 1964, is a prime example. These previously known display assemblies typically comprise a laterally elongated basket having hooked members secured to the back side of the basket at each lateral end thereof. The hooked members are adapted to be received in slots formed through spaced vertical uprights to support the basket in an elevated position.

One disadvantage of these previously known display assemblies, however, is that the hook members on the display assembly are often times misaligned with the receiving slots in the upright supports. This misalignment may be due to any number of factors, but most commonly the misalignment is due to an aggregation of manufacturing tolerances which accummulate to the extent that the display assembly will not fit on the upright supports. Both the display basket and the upright supports are constructed rigidly so that it is not feasible to bend either the upright support or the basket to cure misalignment. Consequently, a second assembly must be substituted for the misaligned assembly in the hope that the second basket will fit onto the upright supports with the hook members properly aligned with the slots in the upright supports.

Another disadvantage of these previously known display assemblies, is that it is sometimes desirable to have the basket of the display assembly in a generally horizontal position while for other types of merchandise it is desirable to have the display basket slope downwardly from the upright supports for maximum visibility of the merchandise. Since the hooked members of the previously known display assemblies have been rigidly secured to the basket portion of the assembly, it has been the previous practice of merchandisers to purchase a number of each type of display assemblies so that the diverse needs of the merchandiser could be accomodated. However, the storage area requirements and relatively high cost of the display assemblies discourage merchandisers from obtaining the number and variety of display assemblies necessary to accommodate the full range of his conceivable needs. Consequently, the merchandiser is typically left with too many display assemblies having horizontal baskets and not enough display assemblies having downwardly sloping baskets, or vice versa.

SUMMARY OF THE PRESENT INVENTION

The display assembly of the present invention overcomes the abovementioned disadvantages of the previously known display assemblies by providing a display assembly with misalignment compensation means. In brief, the assembly comprises a laterally elongated basket having hook members for securing the display assembly onto a pair of spaced upright supports but in which the hook members are laterally slidably attached to the display assembly to thereby compensate for misalignment of the hooked member with the slots in the upright supports.

In addition to the above, the hooked members may be slidably coupled to either the back side or the front side of the display assembly. With the hooked members secured to the back side of the display assembly, the basket portion of the assembly is maintained in a generally horizontal position whereas with the hooked members secured to the front side of the display assembly, the basket assembly slopes downwardly from the upright supports. In this manner, the display assembly of the present invention may be alternatively utilized as either a horizontal or downwardly sloping display assembly.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is an exploded perspective view showing the display assembly of the present invention;

FIG. 2 is a side plan view showing the display assembly of the present invention in a first position;

FIG. 3 is a partial cross sectional view showing the attachment means between the display assembly of the present invention and the upright support, and enlarged for clarity; and FIG. 4 is a cross sectional view taken substantially along line 4—4 in FIG. 3.

DETAILED DESCRIPTION OF THE PRESENT INVENTION

With reference to FIG. 1, the display assembly 10 of the present invention is thereshown and adapted to be secured onto a pair of spaced and parallel upright supports 12 in a manner to be hereinafter described. The display assembly 10 comprises an open ended basket 14 having a back side 20, front side 22, and a bottom 24, integrally formed of a plurality of interlacing wire members. A plurality of dividers 26 may also be secured to the basket 14 thereby forming separate compartments 28 in the basket 14 for the display of different merchandise.

Referring particularly to FIG. 2, an end support bar 30, preferably constructed of square metal tubing is rigidly secured adjacent each lateral and of the basket 14. The end support bar 30 comprises a base portion 32 which runs along the bottom 24 of the basket 14, a front leg 34 secured along the front side 22 of the basket portion 14 and preferably substantially perpendicular to the base portion 32, and a back leg 37 secured along the back side 20 of the basket portion 14. The front and back legs 34 and 36 are preferably of integral construction with the base portion 32 of the end support bar 30. However, unlike the front leg 34, the back leg 36 of the end support bar 30 is angled relative to the base portion 32 so that the longitudinal axes of the front and rear legs 34 and 36, intersect at a point below the base portion 32 of the end support bar 30 for a reason to become hereinafter apparent.

With reference to FIGS. 1 and 2, a pair of spaced and parallel bottom support bars 60 and 62 are secured laterally between the base portions 32 of the end support bars 30. The bottom support bars 60 and 62 are preferably constructed of square metal tubing or of L-shaped frame members welded on a corner to the bottom of the basket and serve to increase the over-all rigidity of the display assembly 10. This permits the basket to be used to span longer lengths than previously possible.

Still referring to FIG. 2 a hooked member 38 is provided to secure the display assembly 10 to each upright support 12. The hooked member 38 is best shown in FIG. 3 and comprises a substantially flat plate member 40 disposed in a vertical plane and having a plurality of hooks 42. Each hook 42 is adapted to be received in a registering slot 44 formed in the upright support 12 so that with the hooks 42 positioned through the slots 44 and forced downwardly as shown in FIG. 3, the plate 40 is firmly secured to the upright support 12.

With reference to FIGS. 2 and 4, in order to secure the hooked member 38 to the display assembly 10, at least one, and preferably three transverse rods 46 are firmly attached by conventional means to each of the plate members 40. The rods 46 register with and are adapted to be received through registering apertures 48 in the back leg 36 of the end support bar 30 so that the entire weight of the display assembly 10 is supported by the rods 46. A removable cap 50 is preferably placed over the open axial end of at least one rod 46 to thereby prevent the hooked member 38 from falling off from the end support bar 30 when the display assembly 10 is removed from the upright support 12. Stop means other than the cap 50 could, of course, be used.

As shown in FIG. 4, the axial length of the rod 46 is somewhat greater than the outside width of the support bar 30 so that a gap 52 exists between the back leg 36 of the support bar 30 and the plate 40 and likewise a gap 54 exists between the cap 50 and the outside surface of the support bar 30. The hooked member 38 thus is laterally slidably mounted to the support bar 30 of the display assembly 10. Consequently, a minor misalignment between the hooks 42 of the member 38 and the slots 44 of the upright support 12 may be compensated for by merely sliding the hooked member 38 along the rods 46 until the hooks 42 register with the slots 44.

In addition, to the misalignment compensation means described above, according to the present invention the display assembly 10 includes means for supporting the basket in either a horizontal or downwardly sloping position from the upright supports 12. With reference to FIG. 2, the front leg 34 of the end support bar 30 is provided with a plurality of apertures 56 which are adapted to register with the transverse lateral rods 46 on the plate member 40. Consequently, by removing the caps 50 from the rods 46, the hooked members 38 may be removed from the back leg 36 of the end support bar 30 and thereinstead be slidably mounted onto the front leg 34 of the end bar support 30 by inserting the rods 46 through apertures 56. As has been previously described, the legs 34 and 36 of the end support bar 30 are angled relative to each other so that with the hooked member 38 secured to the back leg 36, as shown in FIG. 2, the basket 14 slopes downwardly from the upright supports 12. Conversely, with the hooked members 38 secured to the front leg 34 of the end supports 30, the basket 14 extends generally horizontally from the upright supports 12.

It can thus be seen that the display assembly 10 of the present invention provides a novel misalignment compensation means between the display assembly hook members and the upright supports to which the assembly is mounted. In addition, the present invention also provides a novel means whereby the display basket may be maintained in either a horizontal or downwardly sloping position relative to the upright supports by simply repositioning the hook members 38. Moreover, the overall cost of the display assembly of the present invention is only slightly increased over the construction costs for previously known display assemblies.

Having described my invention, many modifications thereto will become apparent to those skilled in the art to which it pertains without deviation from the spirit of the invention as defined by the scope of the appended claims.

I claim:

1. A display assembly adapted to be secured to a pair of spaced and parallel upright supports, said assembly comprising:

a basket portion;

an end support bar secured adjacent each lateral end of said basket portion, and means for removably securing each end of said display assembly to one of said upright supports, said means further comprising a first member having an elongated portion extending normal to said lateral ends which is laterally slidably disposed through one of said end support bars whereby said elongated portion supports said end support bar, and means extending normal to said elongated portion for securing said first member to one of said upright supports whereby the laterally slidable elongated portion compensates for lateral misalignment between the upright supports.

2. The display assembly as defined in claim 1, wherein said first member includes a plurality of hooks adapted to be received within registering slots formed on said upright support and wherein said first member elongated portion comprises at least one elongated rod secured to said first member and transversely slidably disposed through receiving apertures formed through said end support bar.

3. The display assembly as defined in claim 2, and including a removable stop means secured to the end of said rod.

4. The display assembly as defined in claim 1, wherein said end support bar further comprises an elongated base portion secured along the base of said basket portion, a first end leg secured along the back of said basket portion and a second end leg angled relative to said base portion and secured along the front side of said basket portion wherein said base portion, said first end leg and said second end leg lie in substantially a vertical plane.

5. The display assembly as defined in claim 4 wherein said first member elongated portion further comprises at least one rod laterally secured to said first member and slidably disposed through receiving apertures in either of said end legs of said end support bar.

6. The display assembly defined in claim 5, and including a stop member removably secured to the end of said rod to thereby retain said rod through said apertures.

7. The display assembly as defined in claim 5, wherein the longitudinal axes of said end legs of said end support bar intersect at a point below said end support bar base portion.

8. The display assembly as defined in claim 7, wherein the longitudinal axis of one of said end legs is substantially perpendicular to said base portion.

9. The display assembly as defined in claim 1 and including support members mounted to the bottom of said basket portion and extending intermediate said end supports.

10. The display assembly as defined in claim 9, and in which said basket portion is mounted to said upright supports with the bottom of said basket portion disposed in one plane when said last mentioned means are mounted to one end of said end supports and said basket portion is mounted to said upright supports with the bottom of said basket portion disposed in another plane when said last mentioned means are mounted to the other end of said end supports.

* * * * *